US010577919B2

(12) United States Patent
Judd

(10) Patent No.: US 10,577,919 B2
(45) Date of Patent: Mar. 3, 2020

(54) ADAPTIVE ACOUSTIC PULSE SHAPING FOR DISTANCE MEASUREMENTS

(71) Applicant: Stephen Vaughn Judd, Hillsborough, NC (US)

(72) Inventor: Stephen Vaughn Judd, Hillsborough, NC (US)

( * ) Notice: Subject to any disclaimer, the term of this patent is extended or adjusted under 35 U.S.C. 154(b) by 219 days.

(21) Appl. No.: 15/906,884

(22) Filed: Feb. 27, 2018

(65) Prior Publication Data

US 2019/0264554 A1 Aug. 29, 2019

(51) Int. Cl.
*E21B 47/04* (2012.01)
*E21B 47/18* (2012.01)

(52) U.S. Cl.
CPC ..... *E21B 47/04* (2013.01); *E21B 47/18* (2013.01)

(58) Field of Classification Search
None
See application file for complete search history.

(56) References Cited

U.S. PATENT DOCUMENTS

| | | | | |
|---|---|---|---|---|
| 4,318,298 | A | 3/1982 | Godbey et al. | |
| 4,389,164 | A | 6/1983 | Godbey et al. | |
| 4,391,135 | A | 7/1983 | Godbey et al. | |
| 4,934,186 | A | 6/1990 | McCoy | |
| 5,027,655 | A | 7/1991 | Sweet | |
| 5,285,388 | A | 2/1994 | McCoy et al. | |
| 5,829,530 | A | 11/1998 | Nolen | |
| 7,784,538 | B2 | 8/2010 | McCoy et al. | |
| 8,261,819 | B1 | 9/2012 | Gibbs et al. | |
| 2017/0010146 | A1* | 1/2017 | Kassubek | G01N 29/222 |
| 2018/0230797 | A1* | 8/2018 | Seshadri | E21B 47/101 |

* cited by examiner

*Primary Examiner* — Clayton E. LaBalle
*Assistant Examiner* — Dennis Hancock

(57) ABSTRACT

A method to measure the fluid depth in a wellbore is described. An optimized acoustic pulse stream is launched into the wellbore, and the round-trip time-of-flight between the fluid surface and the top of the wellbore is measured. The method provides improved signal to noise ratio, and can be actively tuned to a plurality of wellbore configurations.

16 Claims, 7 Drawing Sheets

Detected signal before tuning

Detected signal after tuning

ADAPTIVE ACOUSTIC PULSE SHAPING FOR DISTANCE MEASUREMENTS

FIELD OF INVENTION

The invention relates to determining the fluid depth in a wellbore by measuring the time required for an acoustic event generated at the top of the wellbore to travel down the wellbore, reflect from the fluid surface, and return to the top of the wellbore. In particular, the invention relates to methods of altering the temporal profile of the acoustic event to improve the accuracy and reliability of measuring the fluid depth.

BACKGROUND OF THE INVENTION

It has become critical to collect information about the liquid level in wells for a variety of reasons. These may include the ability to manage water resources, monitoring civil engineering structures such as dams or buildings, and various earthworks such as bridges, roads, landfills, etc. It is important to determine the actual fluid level and have the ability to monitor fluid level changes over time.

A number of techniques have been invented and commercialized over many decades. As disclosed in U.S. Pat. No. 5,027,655 issued Jul. 2, 1991, the most common method to determine the fluid depth in a well or borehole involves lowering a measuring tape down the wellbore. When the end of the tape contacts the fluid surface, a change in the impedance between two contacts at the end of the tape provides an indication that the fluid surface has been reached, whereupon the fluid depth can be read from the demarcations on the tape. This approach is fraught with uncertainty, since the tape can encounter wet surfaces as it is lowered down the borehole, or become entangled and hung up on protrusions and structures within the borehole, resulting in grossly erroneous readings.

A second method involves lowering a gas-tight tube down to slightly below the fluid surface in the borehole. The pressure in the tube is then increased until bubbles begin to exit at the distal end of the tube. By detecting the presence of bubbles, the pressure required to create the bubbles is measured and, together with the known length of the tubing, used to estimate the depth of the fluid. This method suffers from problems similar to the above described measuring tape technique.

A third method involves introducing a sound pulse at the top of the borehole and directing it to the fluid surface at the bottom of the borehole. By measuring the Time Of Flight (TOF) between launching the pulse and detecting the pulse that reflects from the fluid surface, and knowing the speed of sound in the borehole, the depth of the fluid surface can be estimated. A number of techniques have extended this approach. For example, U.S. Pat. No. 4,934,186 issued Jun. 19, 1990 discloses the detection of reflections from known, regularly spaced collars along the borehole to provide calibration signals for the TOF measurement to the fluid surface. In U.S. Pat. No. 4,389,164 issued Jun. 21, 1983 the inventors disclose the use of a TOF acoustic pulse measurement system to control a pump and thereby maintain a desired fluid level in the borehole. U.S. Pat. No. 4,318,298 issued Mar. 9, 1982 uses an acoustic TOF system to monitor the fluid level in a borehole on a periodic basis.

This approach suffers from false reflections that can result from a plurality of sources, including protrusions, changes in bore diameter, abrupt changes in borehole direction, changes in borehole wall composition, and resonant effects that can occur between one or more of the above-mentioned perturbations.

A fourth technique involves the use of a continuous tone, frequency modulated (frequency chirped) acoustic signal directed down the borehole. The reflected acoustic signal is detected and mixed with the launched signal, and the resulting difference frequency is proportional to the round trip time of flight of the acoustic signal from the top of the borehole to the fluid surface. Alternatively, the continuous tone is frequency modulated in order to maximize the amplitude of the resulting detected signal. In this instance, an acoustic resonant cavity is formed in the borehole between the acoustic source and the fluid surface. Knowledge of the speed of sound in the borehole can be used to estimate the acoustic wavelength of the resonant frequency and thereby the fluid depth. This approach is limited by the need for a significant frequency chirp of a low frequency signal, which can limit the range of borehole depths that can be interrogated.

A fifth technique involves creating an acoustic pulse at the top of a borehole that consists of series-connected casings with identical lengths. The reflected acoustic signals are detected and are comprised of a plurality of reflections from the regularly spaced collars along the borehole, as well as the reflection from the fluid surface. By using the known spacing between collars to calibrate the speed of sound in the borehole, the distance to the fluid surface can be estimated. This approach finds limited utility for boreholes that have contiguous, series-connected casing sections between the top of the well and the fluid surface.

BRIEF SUMMARY OF THE INVENTION

An objective of the present invention is to provide an improved system suitable for measuring the level of water in a borehole or other environment and which substantially reduces the disadvantages of earlier methods. Briefly, the invention consists of launching two short duration acoustic pulses of equal amplitude in rapid succession. The detected acoustic reflections are collected and a measurement of the variation in the total (or a portion) of the detected signal is computed. The time delay between the two pulses is then adjusted and the measurement is repeated. By undergoing a series of measurements, the time delay is found that provides the smallest variation in the detected signal. Once this time delay is determined, the second pulse amplitude is adjusted slightly and a new measurement is collected. The amplitude adjustment is repeated over a range of amplitudes, and the amplitude that corresponds to the smallest signal variation is determined. Once the optimum time delay and amplitude of the second pulse has been found, the sensor uses this optimized double pulse acoustic signal for distance measurements. By performing this tuning process, interfering reflected signals are reduced in amplitude, and the accuracy of the distance measurements is substantially improved, especially for short distances.

One advantage of the present invention is that extraneous acoustic signals that interfere with the distance measurement process are reduced.

Another advantage of the present invention is that it can be applied to acoustic distance sensors that previously used a single acoustic pulse, with no physical modifications to the sensor.

Another advantage of the present invention is that it improves the measurement accuracy at short distances.

Another advantage of the present invention is that it can adjust to different physical installation geometries and arrangements.

Another advantage of the present invention is that it can be applied after the sensor is installed, to correct for changes in the environment that may occur over time or due to physical modifications.

Another advantage of the present invention is that it can be applied after the sensor is installed, to correct for changes in the interfering signals that vary with the distance being measured.

Another advantage of the present invention is that it can be implemented in compact microcontrollers, resulting in a self-contained, physically small electronics package.

BRIEF DESCRIPTION OF THE DRAWINGS

The invention is described in more detail by reference to the included drawings, in which.

DETAILED DESCRIPTION OF THE INVENTION

Figure 1:
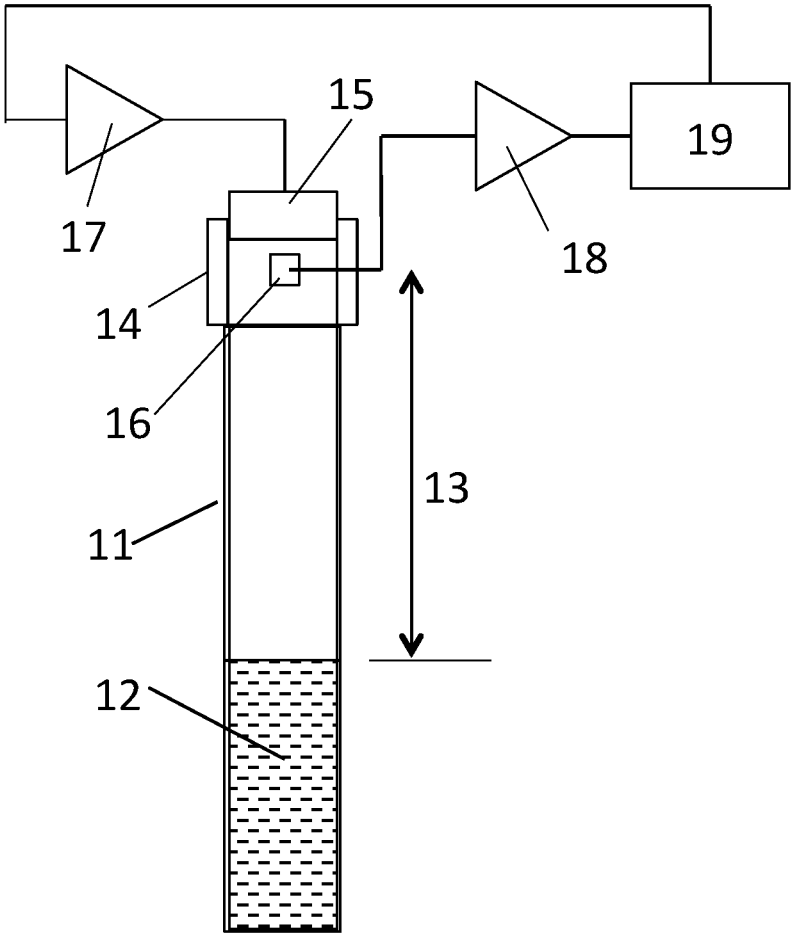
FIG. 1 illustrates acoustic measurement apparatus implemented for measuring liquid depth in a well.

Referring now to the drawings, in FIG. 1 a well 11 contains liquid 12 at a distance 13 from the well entrance. A housing 14 is fastened to the well entrance and contains the components of the sensing apparatus. It is desired to determine the distance 13 by measuring the time of flight of an acoustic pulse generated by a transducer 15 that travels down the well 11, reflects off the liquid surface, and travels back up the well 11 to an acoustic detector 16. It is understood that the pulse generating transducer 15 and the detector 16 may be the same transducer in some embodiments of the present invention. The acoustic pulse transducer 15 is driven by electronic amplifier 17. The amplifier 17 increases the amplitude and current capacity of an electrical pulse generated by an electronic control unit 19. The electronic control unit 19 also receives the acoustic signals detected by acoustic detector 16 after being amplified and filtered by amplifier/filter 18. In normal operation, the electronic control unit 19 generates a pulse that results in an acoustic pulse exiting transducer 15. The acoustic signals detected by detector 16 are increased in amplitude and filtered by amplifier/filter 18, digitized by electronic control unit 19 and further analyzed to create a measurement of the distance 13.

Figure 2:
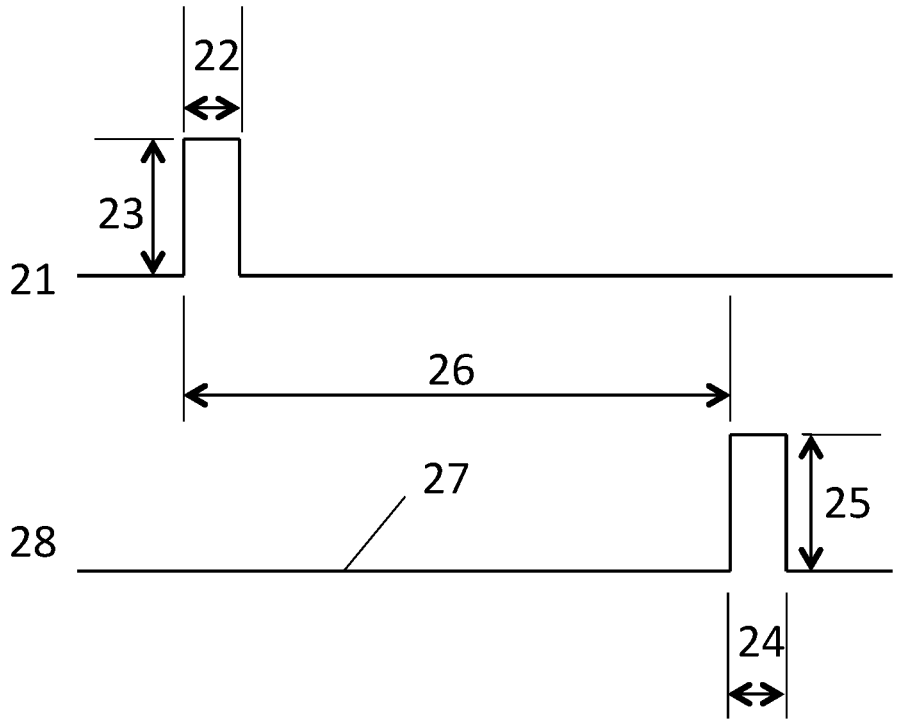
FIG. 2 illustrates the acoustic pulses that are launched down the well, and the acoustic signals that are detected as a function of time, for an ideal case.

The electronic waveforms that are found in an ideal distance measurement system are illustrated in FIG. 2, where the voltage is plotted as a function of time along the horizontal axis. Although a single pulse is displayed, it is understood that the sequence of variations is usually repeated to collect a plurality of distance measurements. These measurements may be combined together or reported individually, depending on the need. In the upper voltage trace 21, an electrical pulse with amplitude 23 and temporal width 22 is used to generate an acoustic pulse of similar shape. The temporal width 22 is selected to match the acoustic frequencies desired for the distance measurement, and typically have a value ranging from 1 microsecond to 100 milliseconds. As shown in the lower voltage trace, after a time delay 26, an acoustic reflection from the liquid surface is detected, with amplitude 25 and temporal width 24. Prior to the arrival of the reflected pulse, there is no appreciable detected signal, as indicated in the trace region 27. By using the speed of sound stored in the electronic control unit 19, the distance from the well entrance to the liquid surface 13 can be calculated using the formula $$D=cT$$

where D is the distance 13, c is the speed of sound in the region of the well 11 above the liquid 12, and T is the time delay or Time of Flight (ToF) 26. In this idealized scenario, the estimated distance 13 has small errors that are ultimately determined by the time measurement accuracy of the electronic control unit 19 and the sharpness of the edges of the launched and detected pulses.

Figure 3:
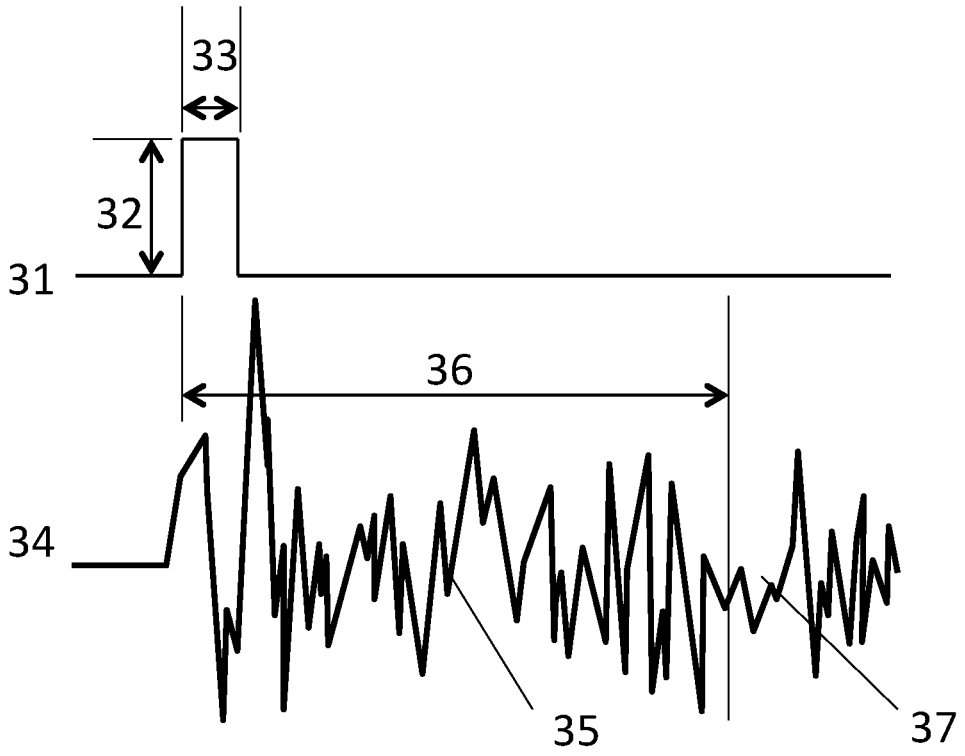
FIG. 3 illustrates the acoustic pulse that is launched down the well, and the acoustic signals that are detected as a function of time, for a realistic case.

In a practical deployment of the sensing apparatus, the waveforms shown in FIG. 2 are not realizable. Rather, the waveforms most commonly encountered are as shown in FIG. 3. In this figure, the launched pulse 31 has amplitude 32 and a pulse length 33. The detected acoustic signal 34 consists of large amplitude variations 35 during and immediately after the acoustic pulse 31, as well as during the entire time of flight 36 of the acoustic pulse. Although difficult to visualize, the actual reflected acoustic signal of interest 37 is buried in large amplitude noise, making it very difficult or impossible to perform an accurate calculation of the distance 13.

Figure 4:
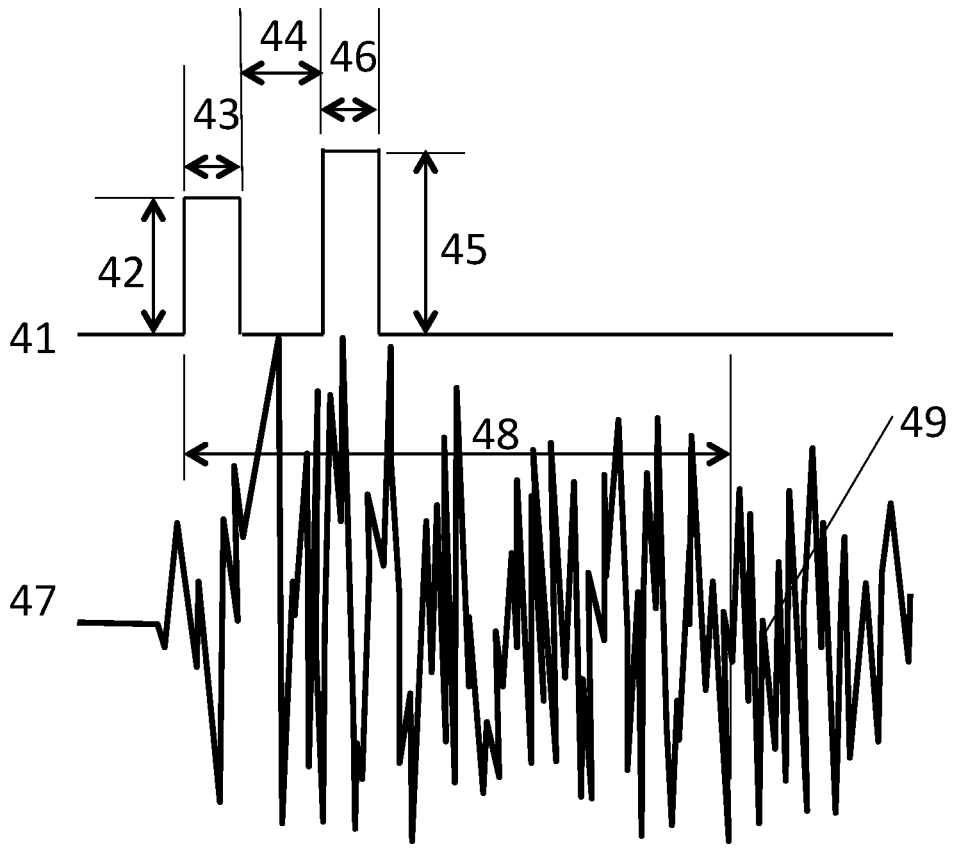
FIG. 4 illustrates the two acoustic pulses that are launched down the well, and the acoustic signals that are detected as a function of time, when the two pulses are not optimized.

In the preferred embodiment of the present invention, one or more additional acoustic pulses are launched into the well entrance to reduce the large amplitude noise 35 shown in FIG. 3. In general, when additional acoustic pulses are introduced into the well entrance, the amplitude of the interfering noise 35 increases dramatically. This is shown in FIG. 4, where two acoustic pulses are shown in voltage trace 41, with first pulse having amplitude 42 and width 43, separated by time delay 44 from a second acoustic pulse having amplitude 45 and pulse width 46. The time delay between the two pulses 44 is typically on the same order of magnitude as the pulse widths of the pulses 43 and 46. The resulting detected acoustic signal is shown in the lower voltage trace 47. The amplitude of the interfering acoustic signals has increased during the ToF interval 48, and the desired acoustic reflection 49 is completely buried in noise. In this example, the measurement of distance 13 is practically impossible.

Figure 5:
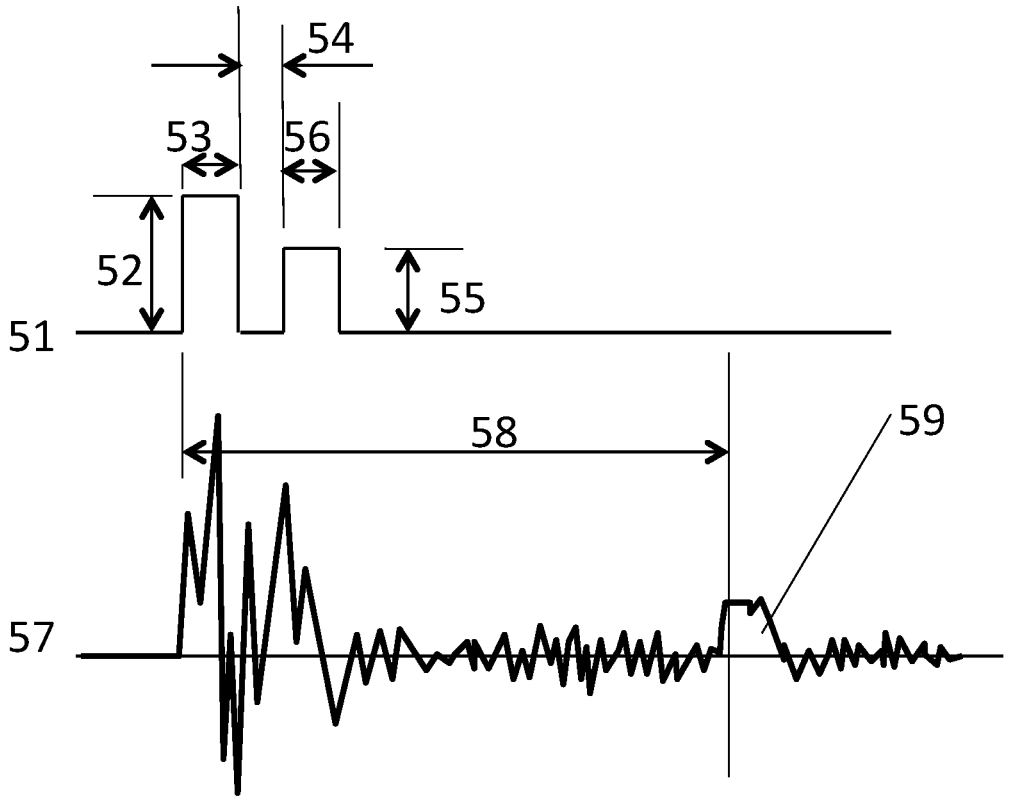
FIG. 5 illustrates the two acoustic pulses that are launched down the well, and the acoustic signals that are detected as a function of time, when the two pulses are optimized.

When the present invention is implemented, the time delay between the two pulses 44 has been adjusted to minimize the amplitude of the interfering noise received by the detector 16. As shown in FIG. 5, two acoustic pulses in voltage trace 51 have amplitudes 52 and 55, pulse widths 53 and 56, and separated by time delay 54. The resulting detected acoustic signal 57 has much lower amplitude interfering signals during the time delay 58, resulting in a clearly identifiable return echo 59 from the surface of the liquid 12.

Figure 6:
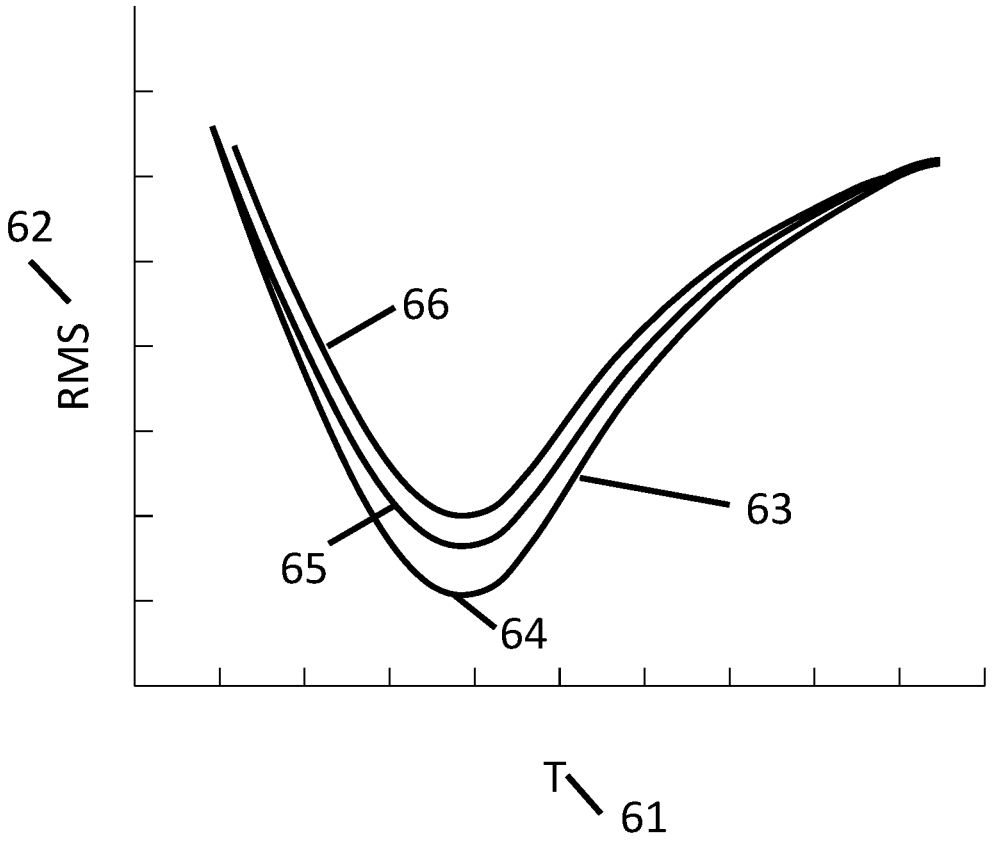
FIG. 6 illustrates the variation in the detected noise as a function of the time delay between two acoustic pulses.

The process of optimizing the pulses involves the following steps and is illustrated in FIG. 6. Two pulses are initially sent down the well with equal amplitudes and an initial time delay T(1). The detected signal is analyzed to create a representation of the amplitude of the total waveform. This may include calculating the absolute value average, the RMS value, the average of the instantaneous amplitudes squared, or other technique. The delay is then shifted to a second value T(2) and the calculation is repeated. This process is repeated for a plurality of time delays, resulting in a table of values that are represented by the curve 63 in FIG. 6, where the RMS value of the detected acoustic signal is shown as a function of time delay T. By searching the table of values, it is possible to identify the time delay T(opt) that produces the smallest interfering signal 64. Adjusting the time delay to T(opt)+tau or T(opt)−tau, where tau is a small time delay, results in an increased amplitude of interfering noise.

Once the optimum time has been identified, the ratio of the amplitude of the first pulse to the second pulse is next adjusted by a small change delta, and the detected noise is calculated. Repeating this process for a variety of delta's results in a series of points near the optimum location 64. The data points will fall above and below the curve 63. The optimum amplitude ratio is found by the data point that has the lowest amplitude of interfering signal. Also shown in FIG. 6 is a second curve 65 that results when the pulse amplitude ratio is lower than the optimum ratio, and a third curve 66 that results when the pulse amplitude ratio is higher than the optimum ratio. In both cases, the local minimum of the curve, although it occurs at the same time delay T(opt), has a higher amplitude value than what is achieved with the optimum amplitude ratio shown in curve 63 and point 64.

Although the example shown here uses two pulses, the process can be extended to larger numbers of pulses if desired.

Figure 7:
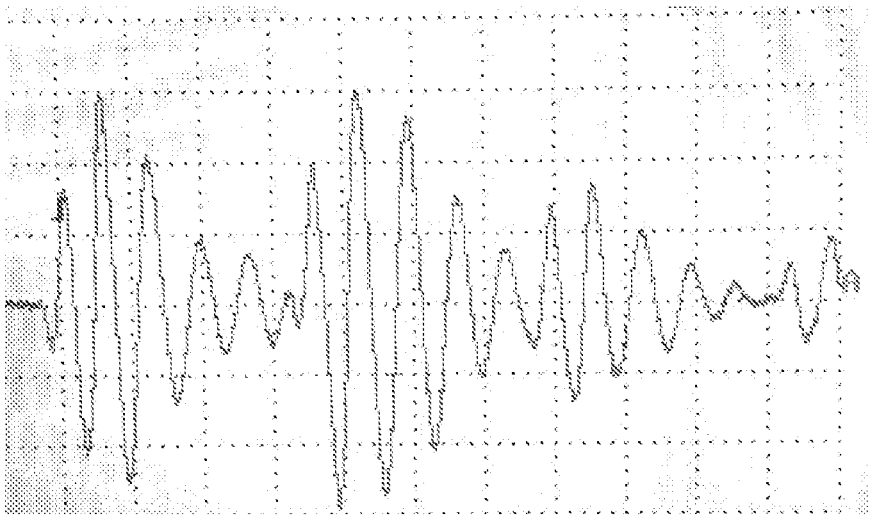
FIG. 7 illustrates an example of the improvement achieved in a prototype device.
Figure 7:
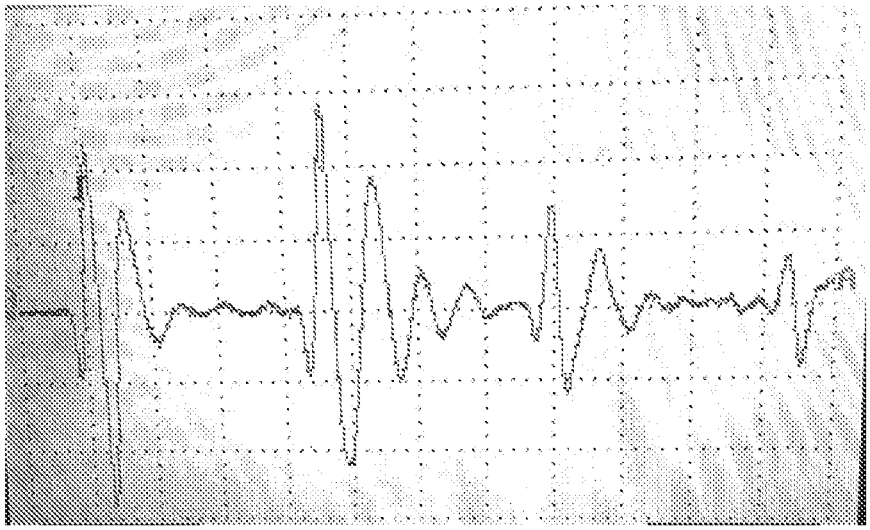

An example of the present invention being implemented is shown in FIG. 7. A transducer assembly launches two pulses down a section of pipe that is used to simulate a well. The detected signals are shown as two traces. The upper trace shows the large amplitude noise that occurs prior to the arrival of the desired acoustic reflection. The lower trace shows the dramatically reduced amplitude noise that occurs once the two pulses have been optimized in time delay and amplitude ratio using the procedure described above.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An apparatus for measuring the distance to an acoustically reflective surface, comprised of: a transducer that generates two or more acoustic pulses; a sensor located proximate to the transducer that detects acoustic reflections after the pulses have ended; a signal processor that calculates the signal amplitude during a portion of said detected signal and records the result; a signal processor that searches for the combination of two or more pulses that results in the smallest amplitude during a portion of said detected signal; a pulse generator controlled by the signal processor that activates the said transducer; and a signal processor that identifies the acoustic reflection from the desired reflective surface, calculates the elapsed time between the generation of the said two or more acoustic pulses and the said desired acoustic reflection and, using the known speed of sound in the region through which the acoustic pulses travel, calculates the distance between the pulse generator and the acoustically reflective surface.

2. The apparatus in claim 1 where the transducer is selected from the list including but not limited to: an electromagnetic speaker, a piezoelectric disc, an electrostatic speaker.

3. The apparatus in claim 1 where the detecting sensor is selected from the list including but not limited to: an electret microphone, a voice coil microphone, a piezoelectric microphone, a capacitive plate microphone, a geophone.

4. The apparatus in claim 1 where two pulses are used.

5. The apparatus in claim 1 where the signal amplitude is found by calculating the root mean squared (RMS) value of the detected signal over a selected time period.

6. The apparatus of claim 1 where the signal amplitude is found by calculating the sum of the absolute value of the detected signal over a selected time period.

7. The apparatus in claim 1 where two pulses are used with the same pulse widths.

8. The apparatus in claim 1 where two pulses are used with differing pulse widths.

9. An method for measuring the distance to an acoustically reflective surface, comprised of: generating two or more acoustic pulses; detecting acoustic reflections after the pulses ended; signal processing that calculates the signal amplitude during a portion of said detected signal and records the result; signal processing that searches for the combination of two or more pulses that results in the smallest amplitude during a portion of said detected signal; pulse generation that is controlled by the signal processor using the said combination of two or more pulses; and signal processing that identifies the acoustic reflection from the desired reflective surface, calculates the elapsed time between the generation of the said two or more acoustic pulses and the said desired acoustic reflection and, using the known speed of sound in the region through which the acoustic pulses travel, calculates the distance between the pulse generator and the acoustically reflective surface.

10. The method in claim [9] where the transducer is selected from the list including but not limited to: an electromagnetic speaker, a piezoelectric disc, an electrostatic speaker.

11. The method in claim 9 where the detecting sensor is selected from the list including but not limited to: an electret microphone, a voice coil microphone, a piezoelectric microphone, a capacitive plate microphone, a geophone.

12. The method in claim 9 where two pulses are used.

13. The method in claim 9 where the signal amplitude is found by calculating the root mean squared (RMS) value of the detected signal over a selected time period.

14. The method in claim 9 where the signal amplitude is found by calculating the sum of the absolute value of the detected signal over a selected time period.

15. The method in claim 9 where two pulses are used with the same pulse widths.

16. The method in claim 9 where two pulses are used with differing pulse widths.

* * * * *